US007293589B2

(12) United States Patent
Boyarski

(10) Patent No.: US 7,293,589 B2
(45) Date of Patent: Nov. 13, 2007

(54) FOLDING COIN PURSE AND METHOD OF MAKING THE SAME

(76) Inventor: Joseph Lee Boyarski, 6511-137 Avenue, Edmonton, Alberta (CA) T5A 0P3

( * ) Notice: Subject to any disclaimer, the term of this patent is extended or adjusted under 35 U.S.C. 154(b) by 0 days.

(21) Appl. No.: 11/131,172

(22) Filed: May 17, 2005

(65) Prior Publication Data

US 2005/0205179 A1 Sep. 22, 2005

Related U.S. Application Data

(63) Continuation-in-part of application No. 10/761,506, filed on Jan. 21, 2004.

(51) Int. Cl.
*A45C 1/02* (2006.01)
*D05B 23/00* (2006.01)

(52) U.S. Cl. ..... 150/153; 150/135; 112/475.08

(58) Field of Classification Search ..... 150/131, 150/136, 150–153; 132/286, 312; 206/0.8, 206/0.84; 229/87.2, 97.2; 112/475.08
See application file for complete search history.

(56) References Cited

U.S. PATENT DOCUMENTS

| | | | | | |
|---|---|---|---|---|---|
| 539,248 | A | * | 5/1895 | Cano | 150/136 |
| 575,809 | A | * | 1/1897 | O'Riva | 281/31 |
| 637,365 | A | * | 11/1899 | Weaver | 150/153 |
| 774,522 | A | * | 11/1904 | Kerst et al. | 150/153 |
| 1,630,654 | A | * | 5/1927 | Buxton | 150/153 |
| 1,885,736 | A | * | 11/1932 | Enfant | 150/153 |
| 2,288,996 | A | * | 7/1942 | Dubilier | 150/150 |
| 2,368,687 | A | | 2/1945 | Stanley | |
| 2,479,524 | A | * | 8/1949 | Tarbox | 206/37.4 |
| 2,612,200 | A | * | 9/1952 | June | 150/136 |
| 2,629,251 | A | * | 2/1953 | Schwalberg | 70/457 |
| 2,810,418 | A | * | 10/1957 | Aschkenasy | 150/153 |
| 2,869,603 | A | * | 1/1959 | Conley | 150/150 |
| 6,039,175 | A | * | 3/2000 | Wright | 206/37 |

FOREIGN PATENT DOCUMENTS

| | | |
|---|---|---|
| JP | 2002 159315 | 6/2002 |

* cited by examiner

*Primary Examiner*—Sue A. Weaver
(74) *Attorney, Agent, or Firm*—Davis Bujold & Daniels, P.L.L.C.

(57) ABSTRACT

This method of making a folding coin purse involves forming a first pocket and a second pocket on a layer of rectangular material. A peripheral border is biased into an upstanding position. The peripheral border frames an access opening between the first pocket and the second pocket. A second half of the body folds over a first half of the body to close the access opening.

9 Claims, 2 Drawing Sheets

FOLDING COIN PURSE AND METHOD OF MAKING THE SAME

This application is a continuation-in-part of U.S. Ser. No. 10/761,506 filed on Jan. 21, 2004.

FIELD OF THE INVENTION

The present invention relates to a folding coin purse, which can be accommodated in a pocket, and a method of making the same.

BACKGROUND OF THE INVENTION

U.S. Pat. No. 2,368,687 (Stanley 1945) is an example of a folding coin purse. The Stanley coin purse consists of an inner flat layer and an outer flat layer of material peripherally stitched to each other. An open access window is provided in one half of the inner flat layer, leaving a loose narrow peripheral margin. The open access window allows the user to view coins within the coin purse and it has a tab to pull up with another hand to lift the end wall up when shuffling coins. The peripheral margin confines the coins. The coin purse folds in half, over the access window, to assume a closed position.

Japanese Patent application 2000357237 (Kojima 2000) similarly discloses a folding coin purse with an inner layer and an outer layer. The inner layer has two "U" shaped peripheral margins arranged in end to end relation, with a transparent material closing in the "U" shape of one half to form a transparent pocket. There is a gap between the "U" shaped peripheral margins, which facilitates the coin purse folding in half. The Kojima patent mentions fixed walls, which means that they are not collapsible.

SUMMARY OF THE INVENTION

The present invention discloses an alternative construction for a folding coin purse with collapsible walls.

According to a first aspect of the present invention there is provided a method of making a folding coin purse with four collapsible walls. A first step involves providing a layer of pliable rectangular material having a first end peripheral edge, a second end peripheral edge, a first side peripheral edge and a second side peripheral edge. A second step involves folding the first end peripheral edge over and securing the first end peripheral edge to the first side peripheral edge and the second side peripheral edge to form a first pocket with wide side seams. A third step involves folding the second end peripheral edge over and securing the second end peripheral edge to the first side peripheral edge and the second side peripheral edge, to form a second pocket with wide side seams. A fourth step involves turning the first pocket and the second pocket inside out. This forms a body with a first inside out pocket as a first end wall, a second inside out pocket as a second end wall and a narrow peripheral border including two side walls, which is created by the side seams and has been biased into an upstanding position by the turning of the first pocket and the second pocket inside out. The peripheral border frames an access opening between the first inverted pocket and the second inverted pocket. A fifth step involves folding a second half of the body over a first half of the body to close the access opening.

In the prior art, an inner layer and an outer layer were secured together about a peripheral edge. This maintained the peripheral border in a relatively flat orientation. With the folding coin purse, as described above, the peripheral border is biased into an upstanding position by the turning of the first pocket and the second pocket inside out. This results in a much fuller peripheral border, which is better adapted to confine coins. The border is so much superior to the prior art, that one-handed operation of the coin purse is made possible.

According to another aspect of the present invention there is also provided an alternative or second method of making a folding coin purse with four collapsible walls. A first step involves providing a layer of pliable rectangular material having a first end peripheral edge, a second end peripheral edge, a first side peripheral edge and a second side peripheral edge. A second step involves curling over each of the first end peripheral edge, the second end peripheral edge, the first side peripheral edge, the second side peripheral edge. The first end peripheral edge is secured to both of the first side peripheral edge and the second side peripheral edge. The second end peripheral edge is secured to both of the first side peripheral edge and the second side peripheral edge. This forms a body with a narrow peripheral border with a first end wall, a second end wall and two side walls, which frames an access opening. A third step involves folding a second half of the body over a first half of the body to close the access opening.

A functioning folding coin purse can be obtained by following either of the two methods described above. A Purse can also be made with one method of walls in one end and another method of walls in the other end of purse. Whether made by the first method or the second method, additional features can be added to further improve performance as will hereinafter be further described.

Even more beneficial results may be obtained by taking a further step of securing a coin confining panel across the peripheral border to form a pocket on the first half of the body. This coin-confining panel can take various forms. It is preferred that a mesh panel, or a transparent plastic panel, be used. Beneficial results have been obtained through the use of a fiberglass mesh commonly used for screen doors and windows, although the mesh could be made out of plastic, nylon or any other materials which can be made to have some flexibility, but retain sufficient stiffness to contain the coins, when the coin purse is folded into a closed position.

Even more beneficial results may be obtained by having flat or curved plastic coin confining stiffeners attached inside the side walls on the second half purse opposite to the coin panel. The stiffeners serve as leverage to hold back the coins when purse is closed, which is also more convenient for one hand operation because it allows weaker fastners to be used to open the purse. A plastic stiffener curved upward and secured inside the end wall on the second half of the purse keeps the opposite ends of the purse closer together, when the purse is closed with fasteners engaged and also retains the coins when shuffling them. Also stiffeners of various materials may be attached to side walls to first half of purse, from near fold line and on, if purse side walls buckle when closing purse due to certain materials. A transparent panel, if used for a coin panel, may serve as a stiffener to the first half purse side walls.

Even more beneficial results may be obtained by taking a further step of having a fully open purse by attaching reinforcing coin confining angled plastic stiffeners to the peripheral border along the first side peripheral edge and the second side peripheral edge spaced from the fold on each of the first half and the second half of the body. The stiffeners improve the ability of the material to confine the coins, when the coin purse is in a closed position and when being moved to an open position.

Even more beneficial results may be obtained by taking a further step of attaching a first fastener to the peripheral border along the first end peripheral edge and a second fastener to the peripheral border along the second end peripheral edge. The first fastener and the second fastener engage to maintain the body in a folded condition. The fasteners can take any number of forms: such as mating tape fasteners or mating snap fasteners.

Even more beneficial results may be obtained by taking a further step of securing a "U" shaped spring along the peripheral border in the first half of the purse, the second half of the purse or both halves of the purse, if needed for fully open purse. The spring biases the peripheral border into an upright orientation.

Even more beneficial results may be obtained by taking a further step of securing elastic materials or silicon etc. in tension, where one end of the elastic in tension is secured to any purse wall desired to have lift and the other end of the elastic rests on the purse body. The elastic or silicon material may be applied or sprayed on, as well, which is an alternative way of biasing the peripheral border into an upright orientation.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

The first method of making a folding coin purse will now be described with reference to FIGS. 1 through 6.

Figure 1:
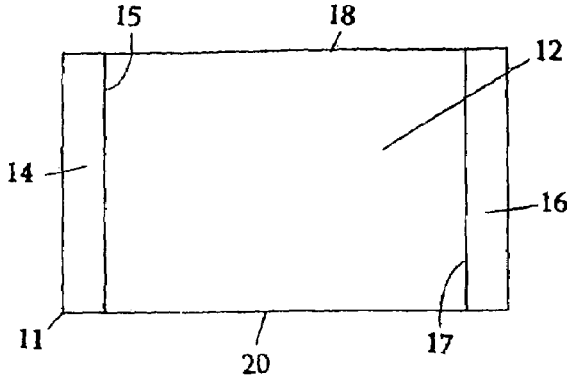
FIG. 1 is a top plan view of a layer of material showing fold lines prior to folding.
Figure 2:
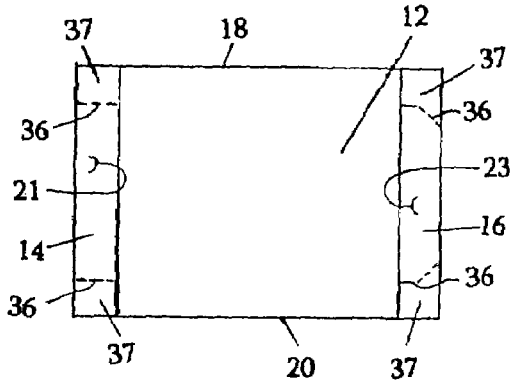
FIG. 2 is a top plan view of the layer of material illustrated in FIG. 1, with folds being made to fold over a first end peripheral edge to form a first pocket and a second end peripheral edge to form a second pocket.
Figure 3:
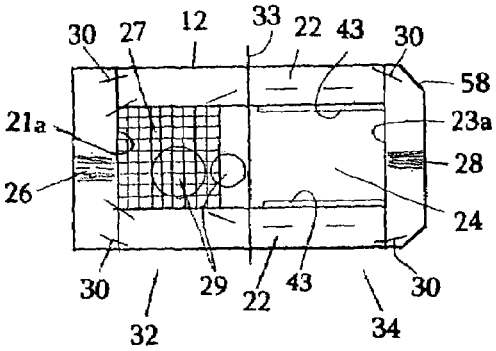
FIG. 3 is a top plan view of the layer of material illustrated in FIG. 2, with the first pocket and the second pocket turned inside out to form a narrow peripheral border made by pocket seams along a first side edge and a second side edge.
Figure 4:
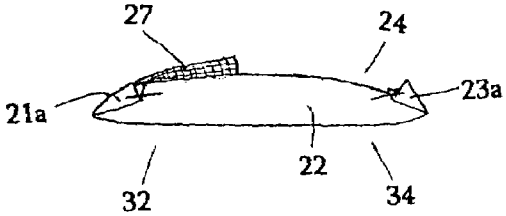
FIG. 4 is a side elevation view of the coin purse illustrated in FIG. 3, in an open orientation.
Figure 5:
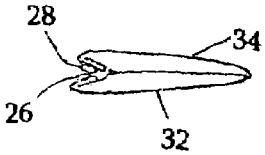
FIG. 5 is a side elevation view of the coin purse illustrated in FIG. 3, in a closed orientation.
Figure 6:
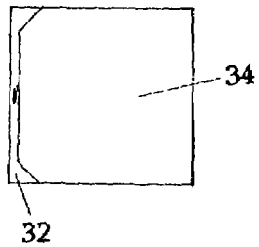
FIG. 6 is a top plan view of the coin purse illustrated in FIG. 5.

Referring to FIG. 1, there is shown a layer of pliable rectangular material 11 having a first end peripheral edge 14, a second end peripheral edge 16, a first side peripheral edge 18 and a second side peripheral edge 20. It will be understood that several pieces of material can be joined to form rectangular material 11. Fold lines 15 and 17 are shown. Referring to FIG. 2, first end peripheral edge 14 is folded over fold line 15 and secured to first side peripheral edge 18 and second side peripheral edge 20 to form a first pocket 21 with wide side seams. Second end peripheral edge 16 is folded over along fold line 17 and secured to first side peripheral edge 18 and second side peripheral edge 20 to form a second pocket 23 with wide side seams. Referring to FIG. 3, first pocket 21 and second pocket 23 are turned inside out. This forms a body 12 with a first inside out pocket 21A which serves as a first end wall, a second inside out pocket 23A which serves as a second end wall and a narrow peripheral border 22 including side walls, which are created from the pocket side seams. Referring to FIG. 4, peripheral border 22 is biased into an upstanding position by the turning of first pocket 21 and second pocket 23 inside out. Referring to FIG. 3, peripheral border 22 frames an access opening 24 between first inside out pocket 21A and second inside out pocket 23A. Referring to FIGS. 5 and 6, a second half 34 of body 12 is folded over a first half 32 of body 12 along a fold line 33 (shown in FIG. 3) to close access opening 24. Referring to FIG. 3, it is preferred that first half 32 of purse body 12 have a viewing window covered by a substrate, such as transparent plastic or mesh 27, that confines coins 29 and which is attached to first inside end wall 21A and inside side walls 22 while enabling coins 29 to be viewed. It is preferred that flat or curved plastic coin confining stiffeners 43 be attached inside side walls 22 on the second half 34 of purse body 12 from fold line 33 to about the end wall. The stiffeners provide leverage to hold coins better allowing weaker fasteners to be used when purse is closed and makes it easier to open the coin purse with one hand. It is also preferred that first half 32 of body 12 have a first fastener 26 and second half 34 of body 12 have a second fastener 28. Referring to FIG. 5, when body 12 is folded first fastener 26 and second fastener 28 are secured together to maintain body 12 in a folded condition. Body 12 may be made from various materials, such as: vinyl, vinyl reinforced with cloth, leather, or other cloth, or a new material somewhat like duct tape. There are various means which may be used to secure first end peripheral edge 14 to first side peripheral edge 18 and second side peripheral edge 20 and second end peripheral edge 16 to first side peripheral edge 18 and second side peripheral edge 20 and including other attachments, such as by staples, taping, sewing, stitching, rivets, heat, glue and the like. Referring to FIG. 2, the illustrated embodiment is shown as having been secured together by sewing, as represented by sewing lines 36. It will be understood that sewing lines 36, can also be considered to describe the line along which staples have been placed if staples are selected as the means of attachment. Similar comments can be made for other methods of attachment. In order to provide a more aesthetically pleasing appearance, sewing lines 36 at second end peripheral edge 16, seams may be angled or curved. Any unnecessary seams, that interfere with the inverting of the pockets, should be removed at the corners prior to inverting the pockets, but after pockets are inverted side walls 22 may be secured to pockets or end walls 21A and 23A shown example by staples 30 in FIG. 3. FIG. 6 illustrates the effect this has when coin purse is folded into a closed position. Once turned inside out, the size of pockets 21A and 23A together with the width of seam 37 control the size of border 22. The width of seams 37 depends upon the positioning of sewing lines 36 relative to the edge of the material sewn. The wider the seam, the higher and wider the side portion of border 22 will be. It should be noted optionally in that pockets 21A and 23A need not be the same size. First pocket 21A can be made larger having a window replaced by a mesh 27 so coins 29 can be viewed which would look much similar to FIG. 3 purse with mesh. This allows mesh 27 to replace a cover for window prior to folding the rectangular material and making larger pocket 21 and smaller pocket 23 with wide seams, after pockets are made and inverted purse has a pocket, with mesh already made. If viewing of coins 29 is not viewed as being important, then mesh 27 becomes redundant. When initially assembling the coin purse, staples may be used as it makes it easy to make and then undo the coin purse, when you are making adjustments as needed. Once the desired spacing is obtained the coin purse may be fastened through sewing, stitching, stapling, riveting, taping, gluing, heat or the like to provide a more permanent final product.

An alternative or second method of making a folding coin purse will now be described with reference to FIGS. 7 through 14. It will be appreciated that all of the additional features described with respect to this second embodiment of coin purse may also be added to the first embodiment of the coin purse and vice versa.

Figure 7:
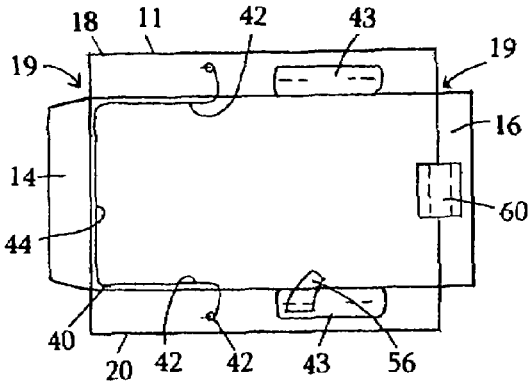
FIG. 7 is a variation of a partially constructed coin purse made for the second method of purse walls.
Figure 8:
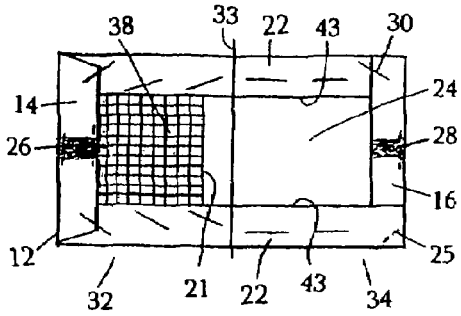
FIG. 8 is a top plan view of another variation of a coin purse.

Referring to FIG. 7, a layer of pliable rectangular material 11 is provided having a first end peripheral edge 14, a second end peripheral edge 16, a first side peripheral edge 18 and a second side peripheral edge 20. It is preferred that corner portions 19 be removed prior to folding of this embodiment. Each of the first end peripheral edge 14, the second end peripheral edge 16, the first side peripheral edge 18, and the second side peripheral edge 20 are curled over to make one end wall. First end peripheral edge 14 is secured to both of first side peripheral edge 18 and second side peripheral edge 20. Second end peripheral edge 16 is secured to both of first side peripheral edge 18 and second side peripheral edge 20 to make another end wall. Referring to FIG. 8, this forms a body 12 with a narrow peripheral border 22 having two end walls 14 and 16 and two side walls 22 which frames an access opening 24. If desired, side walls may be curled over end walls and secured. A second half 34 of body 12 folds over a first half 32 of body 12 along a fold line 33 to close access opening 24. Referring to FIG. 7, optionally, corners 19 can also be cut more, so that when cut off corners are folded, secured and inverted, the seam line runs diagonally at the corner joined walls. Corners 19 may also be cut less in second half 16 of the purse, so that walls may be secured at the corners without having them inverted, as shown in FIG. 8. In FIG. 8, corners are shown as being secured by staples 30; if secured by sewing 25, it reduces the amount of room available for coins at the corners.

Referring to FIG. 8, it is preferred that a coin confining panel 38 extends across peripheral border 22 to form a transparent pocket 21 which may consist of a mesh or transparent plastic on first half 32 of body 12. The mesh used may be the type of fibreglass screen used for doors and windows, plastic, nylon or materials which can be made to have some flexibility, but have sufficient stiffness to hold coins when purse is closed, or it may be a transparent plastic.

Figure 9:
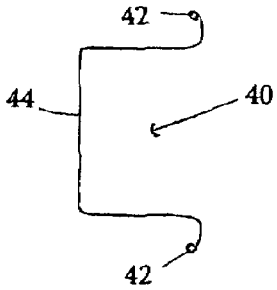
FIG. 9 is a top plan view of a spring.

Referring to FIG. 9, a "U" shaped spring 40 is provided having opposed sides 42 and a center portion 44. Referring to FIG. 7 spring 40 is positioned inside body 12. Sides 42 of the spring 40 are in contact with first side peripheral edge 18 and second side peripheral edge 20. Center part 44 of the spring 40 runs along first end peripheral edge 14 of body 12. Spring 40 biases peripheral border 22 into an upright orientation. Spring 40 allows sides 18 and 20 to be collapsed for storage when body 12 is folded, but urges peripheral border 22 to be extended into an upright orientation when body 12 is open. It will be understood that spring 40 may be added to either end or both ends of the coin purse.

Figure 10:
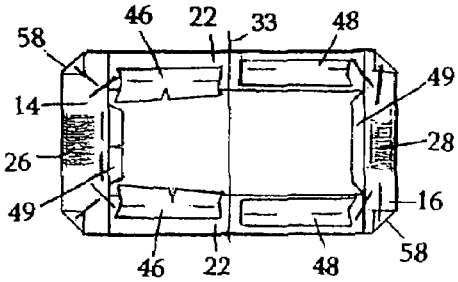
FIG. 10 is a top plan view of another variation of a coin purse fully open to take coins.
Figure 11:
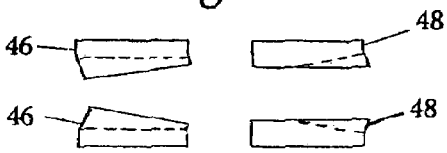
FIG. 11 a top plan view of stiffeners used in FIG. 10.
Figure 12:
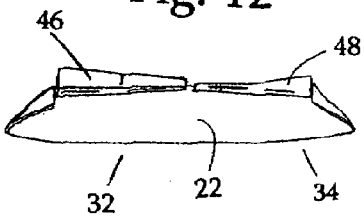
FIG. 12 is a side elevation view of the coin purse of FIG. 10.
Figure 14:
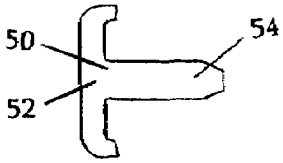
FIG. 14 is a side elevation view of a T-shaped stiffener used to make the coin purse more rigid.

Reinforcing coin confining stiffeners may be attached to peripheral border 22 along first side peripheral edge 18 and second side peripheral edge 20, spaced from fold line 33 on each of first half 32 and second half 34 of body 12. Stiffeners may be secured in different ways. Referring to FIGS. 7 and 8, stiffeners 43 may be attached to peripheral edges 18 and 20 opposite the coin panel to provide leverage to hold coins better when the coin purse is closed. Stiffeners 43 are located underneath peripheral edges 18 and 20. Referring to FIG. 10, angled plastic stiffeners 48 may be attached to the peripheral border 22 of the second half 34 of the purse and stiffeners 46 attached to the peripheral border 22 of the first half 32 of the purse to form a coin barrier. Note that the stiffeners 46 and 48 are attached on top of the peripheral border 22, not underneath. Stiffeners 46 and 48 extend to near the hinge line of the purse but do not cross it so as not to impede the purse being folded. The plastic stiffeners 46 and 48 are shown in FIG. 11, where the dashed lines indicate angle lines along which stiffeners 46 and 48 are made at an angle, of between 25 and 90 degrees. Stiffeners 46 are partially cut midway, so that they bend over coins. Stiffeners 46 and 48 help confine the coins in the purse when the purse is in the closed position and when the purse is being opened. Referring to FIG. 10, there may also be included plastic stiffeners 49 attached underneath peripheral edges 14 and 16 to make the peripheral edges stiffer or fuller, if needed, such that coins are less likely to fall out. A side view of the purse is shown in FIG. 12, with the sides extended, which may be due to the type of fabric, spring 40, or elastic tension which lifts border 22, or a combination thereof. Referring to FIG. 14, a "T" stiffener 50 is shown. This may be secured into the second half 34 or first half 32 or both halves of the purse body to provide a more rigid structure to the purse. The top 52 of the stiffener 50 is located under the first end peripheral edge 14 or second end peripheral edge 16 of the purse, and the stem 54 of the stiffener 50 is matched up with or shorter than the coin purse folding line. Stiffener 50 may be anchored using stitches, sewing, staples, rivets, taping, glue, heat; as can anything in this invention that is fastened or anchored. It will be understood that plastic coin confining stiffeners may be attached to any of the walls of the coin purse, whether its on top of the side walls as shown in FIG. 10, inside the side walls as shown in FIG. 8 or to either side of purse fold line if needed and perhaps projecting above the side walls, or attached inside the end walls and perhaps projecting above the end walls. Inside the side walls is preferred, as the purse looks better that way, but the stiffeners could be positioned outside or on top of the side walls. The stiffeners can be flat, angled or curved. The stiffeners 46 in FIG. 10, fully open purse, can be narrower if the coin purse is made of a marine vinyl, which is more rubbery-like and holds up the walls better. Narrower stiffeners can also be used when the purse has functioning wall lifters which bias the walls upwardly whether in the form of springs or elastic materials. Also stiffeners may be secured to the purse bottom inside purse body sides near the fold lines, if needed, to keep the purse from narrowing at the fold line. When second half purse end wall 16, as shown in FIG. 8, has a curved plastic stiffener, it keeps the purse ends closer together when the purse is closed.

Referring to FIG. 7, there is shown a key holder 60 which may be attached to any walls of purse desired. This may be made of elastic type materials such as spandex, etc. and key is held by inserting it into the holder 60, which is held by elastic properties of the holder 60.

Figure 13:
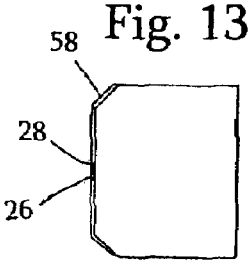
FIG. 13 is a top plan view of a variation of the coin purse of FIG. 10 in a folded position.

Referring to FIG. 10, it may also be convenient to cut and or fold the corners 58 of the purse such that the purse is less likely to catch on clothing when taken out of a pocket. The folded purse is shown in FIG. 13.

Referring to FIG. 7, elastic, silicone material, marine vinyl, etc. 56 may be of various shapes or forms, whereby one end may be secured in tension to any walls of purse desired to have lift and the other end rests on purse body or bottom or they can be applied or sprayed on to bias peripheral border 22 into an upright orientation. Having peripheral border in an upright orientation with elastic material 56 enables coins to be shuffled with one hand if needed, but its more useful for FIG. 10, purse to hold coins when it is closed. Elastic type material 56 is used as an alternative to or to supplement spring 40. Optionally, referring to FIG. 8, tape fasteners 26 and 28 contact when to keep the purse closed. Snap fasteners can be used as an alternative, if desired. To have purse more convenient to use, fasteners can be attached anywhere desired on purse. Tape fasteners may be offset with engagement taking place only when the purse is closed eccentrically toward one side. It may be desirable to use four fasteners, rather than two as shown in FIG. 10, to hold opposite purse end corners together. When four fasteners are used, there is less of a need for plastic stiffeners to end walls 14 & 16, and some pliable material may be used, if desired, to make the purse.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the claims.

What is claimed is:

1. A folding coin purse, comprising:

a body formed from a layer of pliable rectangular material that is not self supporting having a first end peripheral edge, a second end peripheral edge, a first side peripheral edge and a second side peripheral edge, each of the first end peripheral edge, the second end peripheral edge, the first side peripheral edge, the second side peripheral edge being curled over with the first end peripheral edge secured to both of the first side peripheral edge and the second side peripheral edge, and the second end peripheral edge secured to both of the first side peripheral edge and the second side peripheral edge, forming a narrow peripheral border which frames an access opening;

a coin confining panel across the peripheral border to form a pocket on the first half the body, the coin confining panel being one of mesh or transparent plastic so that coins can be viewed through the coin confining panel;

strips of polymer plastic secured as stiffeners to portions of the peripheral border of the body thereby reinforcing the peripheral border so as that the material that is not self supporting is better able to confine coins; and the second half of the body being folded over a first half of the body along a fold line to close the access opening.

2. The folding coin purse as defined in claim 1, wherein a "U" shaped spring is secured along the peripheral border in one of the first half or the second half of the purse, whereby the spring biases the peripheral border into an upright orientation.

3. The folding coin purse as defined in claim 1, wherein elastic material is secured in tension where the first end peripheral edge is secured to the first side peripheral edge and the second side peripheral edge and where the second end peripheral edge is secured the first side peripheral edge and the second side peripheral edge, whereby the elastic material biases the peripheral border into an upright orientation.

4. A method of making a folding coin purse, comprising the steps of:

providing a layer of pliable rectangular material that is not self supporting, the material having a first end peripheral edge, a second end peripheral edge, a first side peripheral edge and a second side peripheral edge;

curling over each of the first end peripheral edge, the second end peripheral edge, the first side peripheral edge, the second side peripheral edge and securing the first end peripheral edge to both of the first side peripheral edge and the second side peripheral edge and securing the second end peripheral edge to both of the first side peripheral edge and the second side peripheral edge, thereby forming a body with a narrow peripheral border which frames an access opening;

attaching strips of polymer plastic as stiffeners to portions of the peripheral border of the body thereby reinforcing the peripheral border so as that the material that is not self supporting is better able to confine coins; and folding the second half of the body over a first half of the body along a fold line to close the access opening.

5. The method as defined in claim 4, including a step of securing a coin confining panel across the peripheral border to form a pocket on the first half of the body, the coin confining panel being one of mesh or transparent plastic so that coins can be viewed through the coin confining panel.

6. The method as defined in claim 4, including a further step of attaching a first fastener to the first half of the body, a second fastener to the second half of the body, whereby the first fastener and the second fastener maintain the body in a folded condition.

7. The method as defined in claim 4, including a further step of securing a "U" shaped spring along the peripheral border in one of the first half or the second half of the purse, whereby the spring biases the peripheral border into an upright orientation.

8. The method as defined in claim 4, including a further step of securing elastic material in tension where the first end peripheral edge is secured to the first side peripheral edge and the second side peripheral edge and where the second end peripheral edge is secured the first side peripheral edge and the second side peripheral edge, whereby the elastic material biases the peripheral border into an upright orientation.

9. The method as defined in claim 4, including a further step of securing an elastic material between end walls of the body, such that a key positioned between the elastic material and the body is held in position by the elastic properties of the elastic material.

* * * * *